US007991327B2

(12) United States Patent
Kabata et al.

(10) Patent No.: US 7,991,327 B2
(45) Date of Patent: Aug. 2, 2011

(54) IMAGE FORMING APPARATUS AND PROCESS CARTRIDGE

(75) Inventors: Toshiyuki Kabata, Kanagawa (JP); Kumiko Hatakeyama, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 837 days.

(21) Appl. No.: 11/769,236

(22) Filed: Jun. 27, 2007

(65) Prior Publication Data

US 2008/0019737 A1 Jan. 24, 2008

(30) Foreign Application Priority Data

Jul. 18, 2006 (JP) ..... 2006-196060

(51) Int. Cl.
*G03G 15/02* (2006.01)

(52) U.S. Cl. ..... 399/176

(58) Field of Classification Search ..... 399/176, 399/159, 168, 174, 50
See application file for complete search history.

(56) References Cited

U.S. PATENT DOCUMENTS

| | | | | |
|---|---|---|---|---|
| 5,126,913 | A * | 6/1992 | Araya et al. | 361/225 |
| 5,146,281 | A * | 9/1992 | Kisu | 399/174 |
| 5,475,471 | A * | 12/1995 | Kisu et al. | 399/115 |
| 5,499,080 | A * | 3/1996 | Furuya et al. | 399/50 |
| 5,546,167 | A * | 8/1996 | Ogata et al. | 399/174 |
| 5,655,188 | A * | 8/1997 | Nagamori et al. | 399/174 |
| 5,666,606 | A * | 9/1997 | Okano et al. | 399/174 |
| 5,671,468 | A * | 9/1997 | Yamamoto et al. | 399/169 |
| 6,014,529 | A * | 1/2000 | Sato | 399/50 |
| 6,052,549 | A * | 4/2000 | Shimura et al. | 399/176 |
| 6,438,331 | B2 * | 8/2002 | Sakaizawa et al. | 399/50 |
| 6,449,449 | B1 * | 9/2002 | Kadonaga | 399/176 |
| 6,606,477 | B2 * | 8/2003 | Thompson et al. | 399/313 |
| 6,690,897 | B2 * | 2/2004 | Takami | 399/50 |
| 6,778,797 | B2 | 8/2004 | Sato et al. | |
| 6,898,393 | B2 * | 5/2005 | Kawamura | 399/100 |
| 7,684,719 | B2 * | 3/2010 | Kitajima | 399/50 |
| 7,738,803 | B2 * | 6/2010 | Fujita et al. | 399/50 |
| 2002/0181970 | A1 * | 12/2002 | Shimizu et al. | 399/149 |
| 2004/0126686 | A1 * | 7/2004 | Toda et al. | 430/58.7 |
| 2005/0084287 | A1 * | 4/2005 | Niimi et al. | 399/111 |
| 2005/0141917 | A1 | 6/2005 | Enoki et al. | |
| 2005/0169668 | A1 | 8/2005 | Koichi et al. | |
| 2005/0238975 | A1 * | 10/2005 | Fujiki et al. | 430/66 |
| 2005/0276632 | A1 | 12/2005 | Ariizumi et al. | |
| 2005/0286934 | A1 * | 12/2005 | DiRubio et al. | 399/176 |
| 2008/0227007 | A1 * | 9/2008 | Tamoto et al. | 430/58.75 |
| 2009/0180788 | A1 * | 7/2009 | Tamoto et al. | 399/48 |

FOREIGN PATENT DOCUMENTS

| | | | |
|---|---|---|---|
| JP | 2001-194868 | | 7/2001 |
| JP | 2004-287027 | | 10/2004 |
| JP | 2004333617 | A * | 11/2004 |
| JP | 2005-309073 | | 11/2005 |
| JP | 2007033848 | A * | 2/2007 |
| JP | 2007121334 | A * | 5/2007 |
| JP | 2007121856 | A * | 5/2007 |

* cited by examiner

*Primary Examiner* — David M Gray
*Assistant Examiner* — Geoffrey T Evans
(74) *Attorney, Agent, or Firm* — Oblon, Spivak, McClelland, Maier & Neustadt, L.L.P.

(57) ABSTRACT

In an image forming apparatus, a photoconductor and a charge roller are in contact with each other and configured to rotate together at linear velocity v (millimeters/second). In this structure, a DC voltage is applied to the photoconductor and the charge roller while they are not rotating. In this state, parameters such as voltage, linear velocity, pressure contact force between the photoconductor and the charge roller are selected so that the ratio w/v (seconds), where w is the interval between two discharge marks occurring on surface of photoconductor, is between 0.005 to 0.035.

21 Claims, 1 Drawing Sheet

IMAGE FORMING APPARATUS AND PROCESS CARTRIDGE

CROSS-REFERENCE TO RELATED APPLICATIONS

The present application claims priority to and incorporates by reference the entire contents of Japanese priority document, 2006-196060 filed in Japan on Jul. 18, 2006.

BACKGROUND OF THE INVENTION

1. Field of the Invention

The present invention relates to a direct current (DC) charging step using a charge roller in an image forming apparatus such as copying machine, printer, facsimile machine, or multifunction product.

2. Description of the Related Art

In an image forming apparatus that employs an electrophotographic process, an image is formed by charging a photoconductor, and conducting light exposure, development, transfer, and fixing. In a charging step (i.e., for charging the photoconductor), as a charger a scorotron charger has been conventionally used, and as a charger roller a charge roller that generates lesser harmful gas, such as ozone, NOx, from the viewpoint of bad effect on environment and realizes downsizing of apparatus is used.

In the charging step, a so-called alternate current (AC) charging system which applies voltage in which AC voltage is overlapped with DC voltage has been used (for example, see Japanese Patent Application Laid-open No. 2001-194868 and Japanese Patent Application Laid-open No. 2005-309073). The AC charging system can charge a photoconductor effectively, so that charge potential of the photoconductor is easy to be uniformized. In the AC charging system, however, positive charging and negative charging occur a number of times within a period of a second, corresponding to the frequency of AC voltage. Because the energy that is generated in a single charging is large enough to decompose an organic substance by oxidization, the photoconductor and the charge roller are oxidized and deteriorated early. Furthermore, because the surface of photoconductor and surface of charge roller which are oxidized by AC charging are more susceptive to adhesion of toner ingredients (toner resin, wax, externally added substances (such as silica or titanium oxide)) and ingredients of paper, these substances having adhered to the photoconductor or the charge roller may not be removed. When such a phenomenon occurs in a photoconductor, surface resistance of the photoconductor at high humidity environment decreases, and a latent image is equalized, leading the phenomenon of image bleeding. Further, in a charge roller, resistance of the charge roller partially elevates in low humidity environment, and faulty in charging may be caused at that part.

On the other hand, image forming apparatuses are known in which only DC voltage is applied on a charge roller (for example, see Japanese Patent Application Laid-open No. 2004-287027). However, in such an image forming apparatus, unevenness in charging is more likely to occur although deterioration in photoconductor and charge roller is smaller than the case using AC charging. This is attributable to the fact that charge potential of a photoconductor will converge to potential of DC current by repetition of positive charging and negative charging in the case of AC charging, whereas, when only DC voltage is applied, discharge occurs only in one direction according to the capacitor model. In other words, when DC voltage is applied to the charge roller while the photoconductor is not charged at all, large discharge current flows immediately after the application, and the discharge current fails to flow immediately as charge potential of the photoconductor increases. When surface resistance of photoconductor and resistance of the charge roller are perfectly uniform, and the assembly accuracy of the photoconductor and the charge roller is perfect, unevenness will not occur in charge potential of the photoconductor. However, when an image of such high quality exceeding 1000 dots per inch of writing to the photoconductor is to be formed, unevenness in charging of the photoconductor is inevitable, so that an image of high quality cannot be formed.

The present inventors made detailed observation to understand why charging unevenness occurs upon application of only DC voltage on a charge roller. A photoconductor and a contact-type charge roller are arranged, and the photoconductor is rotated with regard to one point (hereinafter, "point A") on the photoconductor, and DC voltage is applied on the charge roller. According to the Paschen's law, discharge is started when the distance between point A and surface of the charge roller is equal to or less than a certain value. As the distance from surface of the charge roller reduces by rotation of point A, a threshold potential difference between the photoconductor and the charge roller where discharge occurs is small according to the Paschen's law, however, since potential at point A has been increased due to discharge theretofore, potential difference between point A and the charge roller is small, and discharge becomes difficult to occur. As point A further rotates and distance between the photoconductor and the charge roller is equal to or less than a certain value, discharge no longer occurs. Even when point A passes the position where the photoconductor and the charge roller contact each other, and further rotates to reach a distance that allows discharge according to the Paschen's law, potential at point A is already high and potential difference between point A and the charge roller is small, so that discharge rarely occurs. In this way, when only DC voltage is applied on the charge roller, discharge occurs only on the upstream side from the position where the photoconductor and the charge roller contact each other, and discharge occurs only continuously. When charging unevenness of the photoconductor widely spans on the downstream side from the position where the photoconductor and the charge roller contact each other, discharge may occurs, however, since the part of charging unevenness is typically in the form of small dots, discharge rarely occurs under the influence of a part where charging unevenness does not occur and charging potential is normal.

On the other hand, when DC voltage and AC voltage are overlapped on the charge roller, positive discharge and negative discharge occur a number of times in a second corresponding to frequency, and discharge occurs not only on the upstream side from the position where the photoconductor and the charge roller contact each other, but also on the downstream side, so that discharge occurs even in the part where discharge is difficult to occur, and charging potential is uniform.

The present inventors made further observation regarding potential change of the photoconductor when only DC voltage is applied on the charge roller, and found that discharge sometimes occurs on the downstream side from the position where the photoconductor and the charge roller contact each other when the linear velocity of the photoconductor is low. This would be attributed to the fact that when the photoconductor is charged by discharge, the charges do not remain in the part where discharge occurs, and a part of area that allows occurrence of discharge is created by disappearance of charges due to dark attenuation, or by dispersion of charges. We also found that for reconstruction of a part of area that allows discharge on the downstream side from the position where the photoconductor and the charge roller contact each other, a certain degree of time is required, and time for passage through the parts where discharge does not occur according to the Paschen's law before and after the position where the photoconductor and the charge roller contact each other is important.

According to the Paschen's law, discharge between conductors is indicated, however, since both the photoconductor and the charge roller include capacity components, potential difference that allows discharge is actually higher than that indicated by the Paschen's law, and distance between the photoconductor and the charge roller that allows discharge is actually wide, and differs depending on the image forming apparatus.

In view of the above, the present inventors made diligent efforts to locate the part where discharge can occur, and the part where discharge cannot occur, and found that when a photoconductor and a charge roller are disposed in contact with each other, and DC voltage is intermittently applied on the charge roller while the photoconductor and the charge roller are not rotated and the photoconductor is exposed to light, two lines (discharge mark) arise in the part where discharge occurs on the photoconductor surface.

The inventors found that when the center interval of discharge mark of the photoconductor (width of gap) and the linear velocity of the photoconductor fall within specified ranges, the charging potential of the photoconductor is uniform and a high quality image can be formed with high resolution, and accomplished the present invention.

SUMMARY OF THE INVENTION

It is an object of the present invention to at least partially solve the problems in the conventional technology.

According to an aspect of the present invention, an image forming apparatus includes a photoconductor configured to rotate at linear velocity v [millimeters/second] at the time of image formation; a charge roller that is in contact with the photoconductor and that is configured to rotate along with the photoconductor; and a charging unit configured to apply direct current voltage between the charge roller and the photoconductor. When w is an interval between two discharge marks occurring on the photoconductor upon intermittent application of the direct current voltage for a predetermined time while the photoconductor and the charge roller are not rotating in an environment where the photoconductor and the charge roller are illuminated with light, ratio w/v is from 0.005 to 0.035.

According to another aspect of the present invention, a process cartridge for use in an image forming apparatus integrally includes a photoconductor configured to rotate at linear velocity v [millimeters/second] at the time of image formation; a charge roller that is in contact with the photoconductor and that is configured to rotate along with the photoconductor; a charging unit configured to apply direct current voltage between the charge roller and the photoconductor, wherein when w [millimeters] is an interval between two discharge marks occurring on the photoconductor upon intermittent application of the direct current voltage for a predetermined time while the photoconductor and the charge roller are not rotating in an environment where the photoconductor and the charge roller are illuminated with light, ratio w/v [second] is from 0.005 to 0.035; a developing device that develops an image formed on the photoconductor with toner; and a cleaning device that cleans residual toner on the photoconductor.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
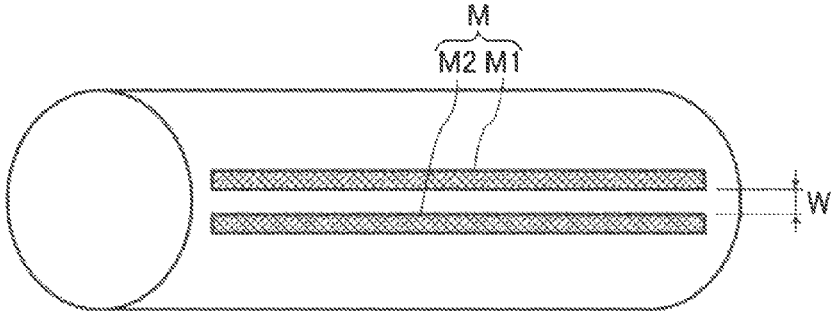
FIG. 1 is a schematic view of a discharge mark occurring on the surface of a photoconductor.

When DC voltage is applied intermittently for a certain time in the condition that a photoconductor and a charge roller contact each other, in an environment under light while the photoconductor and the charge roller are not rotated, the ratio (w/v) (second) between the width w (millimeters) of a gap in a center part of discharge marks in an image formation area occurring in the photoconductor, and the linear velocity v (m/s) of the photoconductor is from 0.005 second to 0.035 second, preferably from 0.006 second to 0.032 second, and more preferably from 0.007 second to 0.030 second.

The parameter w/v represents the time in which a specified one point on the photoconductor passes through the gap part of width w.

w/v of equal to or less than 0.005 second is not preferable because it is too short for charges on the photoconductor to be rearranged on the upstream side of the contacting part between the photoconductor and the charge roller, and discharge will not occur even at a portion with a low charging potential on the downstream side of the contacting position between the photoconductor and the charge roller, leading unevenness in charging potential and deterioration in image quality. Also, w/v of equal to more than 0.35 second is not practicable because image formation speed is low.

The DC voltage which is applied intermittently for a certain time while both the photoconductor and the charge roller in the image forming apparatus of the present invention are not rotated is preferably voltage which is applied in an actual image forming apparatus. In general, a charge roller has both conductive mechanisms of ion conductivity and electron conductivity, and since ion conduction, in particular, changes in environment (such as temperature and humidity), the image forming apparatus is often equipped with a thermohygrometer to change the voltage applied to the charge roller depending on the temperature and humidity, or measures density of an image to be formed and changes the voltage applied to charge roller so that image density is constant. Therefore, it is preferred to set the application condition in the case of using a fresh developing agent in an environment where the image forming apparatus is mainly used (for example, temperature 23° C., humidity 55%). Usually, voltage to be applied to the charge roller is from −1400V to −3500V, preferably from −1450V to −3250V, and more preferably from −1500V to −3000V.

For forming a charge mark by applying DC voltage intermittently for a certain time while both the photoconductor and the charge roller in the image forming apparatus of the present invention are not rotated, such operation should be conducted while the photoconductor is exposed to light. By exposing the photoconductor to light, potential of the photoconductor rapidly becomes roughly 0 volt even when the photoconductor is charged, and enables repeated discharge. When charging is conducted in a dark room, discharge immediately ends so that a discharge mark will not occur on the photoconductor. As light to be hit on the photoconductor, any light having a specified wavelength may be used insofar as such wavelength is sensible by the photoconductor, and white light (incandescent lamp, fluorescent lamp) is preferred because it has wavelength which is sensible by the photoconductor. Intensity of light may be of office environment level, and is 75 lx or higher, preferably 100 lx or higher, and more preferably 120 to 500 lx by measurement of a luminometer.

As a method of applying DC voltage intermittently for a certain time while both the photoconductor and the charge roller in the image forming apparatus of the present invention are not rotated, any condition may be employed insofar as a discharge mark is formed on the photoconductor, however, the number of applying DC voltage in a second is from 500 to 3000 times, preferably from 750 to 2000 times, and more preferably from 900 to 1500 times, and the interval is from 0.1 millisecond to 1 millisecond, and preferably from 0.2 millisecond to 0.8 millisecond. Total time in which charging is executed is from 5 minutes to 60 minutes, and preferably from 10 to 30 minutes.

FIG. 1 is a schematic view of a discharge mark formed on the surface of the photoconductor.

In FIG. 1, the notation "M" represents a discharge mark, and "w" represents an interval between two discharge marks.

Discharge mark M includes two continuous lines (M1, M2), and between these lines, a part where discharge does not occur can be observed. Width w of the part where discharge does not occur is measured. Value of "w" is from 0.8 millimeter to 4.0 millimeters, preferably from 1.0 millimeter to 3.7 millimeters, and more preferably from 1.2 millimeters to 3.5 millimeters. When w is equal to or less than 0.8 millimeters, the time required for rearrangement of charges on the charged photoconductor on the upstream side of the position where the photoconductor and the charge roller contact each other is short, and discharge does not occur in the part where charge potential is low on the downstream side of the part where the photoconductor and the charge roller contact each other, so that unevenness in charging potential arises and image quality is reduced. Width w of equal to or more than 4.0 millimeters is not preferable because the diameter of the charge roller should be made larger, and the size of the image forming apparatus increases.

The discharge mark in the image forming apparatus of the present invention can be readily observed under an optical microscope or electron microscope.

Since this observation is destructive inspection, the photoconductor used for observation can no longer be used as an image forming apparatus. The same applies to the charge roller because a discharge mark is left. Since voltage is applied while the photoconductor and the charge roller are in stationary states, by using the identical photoconductor and charge roller and changing the position where they oppose each other, different discharge marks may be formed repeatedly and observed.

As such observation, parameters for forming best image may be selected by conducting the observation using an experimental apparatus principally in the stage of designing, however, it is also possible to modify linear velocity of photoconductor of the same lot, contact pressure between photoconductor and charge roller, value of applied DC voltage and the like by conducting such observation using a finished image forming apparatus. Further, when a trouble occurs in an image forming apparatus which is being used, similar observation may be made to clarify the problematic point of the trouble.

Linear velocity v of the photoconductor in the image forming apparatus of the present invention is from 80 mm/s to 500 mm/s, preferably from 90 mm/s to 450 mm/s, and more preferably from 100 mm/s to 400 mm/s. Linear velocity v of photoconductor of less than 80 mm/s is not practical because speed of image formation is low. Linear velocity v of photoconductor of equal to or more than 500 mm/s is not preferable because the time required for rearrangement of charges on the charged photoconductor on the upstream side of the position where the photoconductor and the charge roller contact each other is short, and discharge does not occur in the part where charge potential is low on the downstream side of the part where the photoconductor and the charge roller contact each other, so that unevenness in charge potential arises and image quality is reduced.

In the image forming apparatus of the present invention, it is important to increase the distance w between two discharge marks. The best way to achieve this is to increase the diameter of the charge roller. As the diameter of the charge roller, maximum diameter that is allowed by the size of the image forming apparatus process cartridge is preferred, and the diameter is from 12 millimeters to 25 millimeters, preferably from 13 millimeters to 23 millimeters, and more preferably from 14 millimeters to 20 millimeters. Diameter of charge roller of equal to or less than 12 millimeters is not preferable because it is impossible to form an image of high quality unless the linear velocity of image forming apparatus is made small because sufficient w cannot be ensured. Diameter of charge roller of equal to or more than 25 millimeters is not preferable because the size of the image forming apparatus process cartridge is too large.

It is also effective to bring a charge roller made of elastic member into abutment on the photoconductor, thereby deforming the charge roller in the part where it is in contact with the photoconductor. However, if the deformation of the charge roller in the part where it is in contact with the photoconductor is too large, the life-time of the charge roller is shortened, and the burden on the photoconductor tends to increase. Therefore, the contacting width between the charge roller and the photoconductor is equal to or less than 3 millimeters, and preferably not more than 2.5 millimeters.

The photoconductor used in the image forming apparatus of the present invention is made up of a conductive support and a photosensitive layer provided thereon. The photosensitive layer may be of a monolayer type in which a charge generation material and a charge transport material are mixed, or a forward lamination type in which a charge transport layer is provided on a charge generation layer, or a reverse lamination type in which a charge generation layer is provided on the charge transport layer. A protective layer may be provided on the photosensitive layer. Between the photosensitive layer and the conductive support, a backing layer may be provided. Each layer may be added with an appropriate amount of plasticizer, antioxidant, leveling agent and the like as necessary.

As the conductive support of the photoconductor, film-form or cylindrical plastic or paper covered with metal such as aluminum, nickel, chromium, nichrome, copper, gold, silver or platinum or metal oxide such as tin oxide or indium oxide having conductivity of volume resistance of equal to or less than 1010 Ωcm, by vapor deposition or spattering; or plate such as aluminum, aluminum alloy, nickel, stainless, or a tube obtained by making a drum tube by extrusion or drawing process, subjected to surface treatment such as grinding, superfinishing, polishing and the like may be used. As the drum-like support, those having a diameter ranging from 20 millimeters to 150 millimeters, preferably from 24 millimeters to 100 millimeters, more preferably from 28 millimeters to 70 millimeters can be used. Diameter of drum-like support of equal to or less than 20 millimeters is not preferable because arrangement of charging, light exposure, development, transfer and cleaning around the drum is physically difficult, and diameter of drum-like support of equal to or more than 150 millimeters is not preferable because the size of image forming apparatus increases. When the image forming apparatus is of tandem type, in particular, the diameter is equal to or less than 70 millimeters, and preferably equal to or less than 60 millimeters because a plurality of photoconductors should be disposed. Also a known endless nickel belt or endless stainless belt may be used as a conductive support.

As a backing layer of photoconductor for use in the image forming apparatus of the present invention, those based on a resin or based on a white pigment and a resin, as well as metal oxide film obtainable by chemically or electrochemically oxidizing surface of conductive base can be exemplified, and those based on a white pigment and a resin are preferred. As the white pigment, metal oxides such as titanium oxide, aluminum oxide, zirconium oxide, zinc oxide are exemplified, and among these, it is most preferred to contain titanium oxide having excellent ability to prevent charges from being injected from the conductive base. Examples of the resin used in the backing layer include thermoplastic resins such as polyamide, polyvinyl alcohol, casein, methyl cellulose, thermosetting resins such as acryl, phenol, melamine, alkyd, unsaturated polyester, epoxy, and mixtures of one or many of these.

As a charge generation substance of photoconductor for use in the image forming apparatus of the present invention, for example, organic pigments and dyes such as azo pigments such as monoazo pigments, bisazo pigments, trisazo pigments, tetrakisazo pigments, triarylmethane dyes, thiazine dyes, oxazine dyes, xanthene dyes, cyanine dyestuffs, styryl dyestuffs, pyrylium dyes, quinacridone dyes, indigo dyes, perylene pigments, polycyclic quinone pigments, bisbenzimidazole pigments, indathrone pigments, squarylium pigments and phthalocyanine pigments; or inorganic materials such as serene, serene-arsenic, serene-tellurium, cadmium sulfide, zinc oxide, titanium oxide and amorphous silicon may be used, and the charge generation substance may be used singly or in combination of plural kinds.

As the charge transport substance of photoconductor for use in the image forming apparatus of the present invention, for example, anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives, triphenylmethane derivatives may be used singly or in combination of plural kinds.

As a binding resin used for forming the photosensitive layer of charge generation layer and charge transport layer, resins showing electric insulation, which are well-known per se, such as thermoplastic resins, thermosetting resins, photosetting resins, and photoconductive resins may be used. Appropriate examples of binding resin include one kind or mixture of plural kinds of binding resins including, but are not limited to, thermoplastic resins such as polyvinyl chloride, polyvinylidene chloride, vinyl chloride-vinyl acetate copolymer, vinyl chloride-vinyl acetate-maleic anhydride copolymer, ethylene-vinyl acetate copolymer, polyvinyl butyral, polyvinyl acetal, polyester, phenoxy resin, (meth)acryl resin, polystyrene, polycarbonate, polyacrylate, polysulfone, polyethersulfone and ABS resin; thermosetting resins such as phenol resin, epoxy resin, urethane resin, melamine resin, isocyanate resin, alkyd resin, silicone resin and thermosetting acryl resin; and photoconductive resins such as polyvinyl carbazole, polyvinyl anthracene and polyvinylpyrene.

As the antioxidant, for example, those listed below may be used.

Monophenol Compounds 2,6-di-t-butyl-p-cresol, butylated hydroxy anisole, 2,6-di-t-butyl-4-ethylphenol, stearyl-β-(3,5-di-t-butyl-4-hydroxyphenyl) propionate, 3-t-butyl-4-hydroxyanisole and so on.

Bisphenol Compounds 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol) and so on.

Polymeric Phenol Compounds 1,1,3-tris-(2-methyl-4-hydroxy-5-t-butylphenyl) butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, tocopherols and so on.

p-phenylenediamines

N-phenyl-N'-isopropyl-p-phenylene diamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine and so on.

Hydroquinones 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and so on.

Organic Sulfur Compounds

Dilauryl-3,3'-thiodipropionate, distearyl-3,3'-thiodipropionate, ditetradecyl-3,3'-thiodipropionate and so on.

Organic Phosphor Compounds

Triphenyl phosphine, tri(nonylphenyl)phosphine, tri(dinonylphenyl)phosphine, tricresyl phosphine, tri(2,4-dibutylphenoxy)phosphine and so on.

As the plasticizer, resin such as dibutylphthalate and dioctylphthalate that is commonly used as a plasticizer may be directly used, and an appropriate use amount is about 0 to 30 parts by weight, relative to 100 parts by weight of binding resin.

A leveling agent may be added to the charge transport layer. As the leveling agent, silicone oils such as dimethyl silicone oil or methylphenyl silicone oil, or polymers or oligomers having perfluoroalkyl group as a side chain is used, and an appropriate use amount is about 0 to 1 part by weight, relative to 100 parts by weight of binding resin.

A protective layer is provided for improving mechanical strength, abrasion resistance, gas resistance, cleanability of the photoconductor. As the protective layer, those of polymer having higher mechanical strength than the photosensitive layer, and those of polymer in which inorganic fillers are dispersed can be exemplified. The polymer used for the protective layer may be any polymers including thermoplastic polymers and thermosetting polymers, and thermosetting polymers are particularly preferred because they have high mechanical strength and very good ability of suppressing abrasion due to friction with a cleaning blade. The protective layer may not have charge transport ability insofar as it is a small film thickness, however, when a thick protective layer not having charge transport ability is formed, decrease in sensitivity of photoconductor, increase in post-exposure potential and increase in residual potential tend to occur. Therefore, it is preferred to contain the charge transport substance in the protective layer or to use polymer having charge transport ability for the protective layer. Since the photosensitive layer and the protective layer largely differ in mechanical strength generally, when the protective layer abrades away and disappears due to friction with cleaning blade, the photosensitive layer will soon abrade away. Therefore, in providing a protective layer, it is important that the protective layer has a sufficient film thickness, ranging from 0.01 micrometer to 12 micrometers, preferably ranging from 1 micrometer to 10 micrometers, and more preferably from 2 micrometers to 8 micrometers. Film thickness of protective layer of equal to or less than 0.1 micrometer is not preferred because it is so thin that partial disappearance is likely to occur due to friction with cleaning blade, and abrasion of photosensitive layer proceeds from the disappeared part. Film thickness of protective layer of equal to or more than 12 micrometers is not preferred because, decrease in sensitivity, increase in post-exposure potential, and increase in residual potential are likely to occur, and cost of polymer having charge transport ability is high particularly when polymer having charge transport ability is used.

As the polymer used in the protective layer, those having transparency to writing light at the time of image formation, and having excellent insulation, mechanical strength and adhesiveness are preferred. And as such, ABS resin, ACS resin, olefin-vinyl monomer copolymer, chlorinated polyether, allyl resin, phenol resin, polyacetal, polyamide, polyamidoimide, polyacrylate, polyallylsulfone, polybutylene, polybutyleneterephthalate, polycarbonate, polyethersulfone, polyethylene, polyethyleneterephthalate, polyimide, acryl resin, polymethylpentene, polypropylene, polyphenyleneoxide, polysulfone, polystyrene, AS resin, butadiene-styrene copolymer, polyurethane, polyvinyl chloride, polyvinylidene chloride, epoxy resin and the like can be exemplified. These polymers may be thermoplastic polymers, however, by conversion into thermosetting polymer by cross-linking using a cross-linking agent having a multi-functional acryloyl group, carboxyl group, hydroxyl group, amino group or the like for improvement of mechanical strength of polymer, it is possible to increase the mechanical strength of the protective layer and to greatly reduce the abrasion due to friction with cleaning blade.

As described above, the protective layer preferably has charge transport ability, and for impartment of charge transport ability to the protective layer, a method of using a polymer for use in the protective layer mixed with the above charge transport substance, and a method of using a polymer having charge transport ability for the protective layer can be expected. The latter method is preferred because a photoconductor of high sensitivity with less post-exposure potential increase and less residual potential increase can be obtained.

As the polymer having charge transport ability, a polymer into which a group having charge transport ability is added is used. As a group having charge transport ability, Chemical formula (1) can be exemplified:

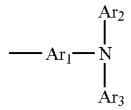

(1)

$Ar_1$ represents an optionally substituted arylene group. $Ar_2$ and $Ar_3$, which may be same or different, each represent an optionally substituted aryl group.

This group having charge transport ability is preferably added to a side chain of a polymer having high mechanical strength such as polycarbonate resin or acryl resin, and it is preferred to use acryl resin which is advantageous in respect of application and curing, and for which production of monomer is easy.

Acryl resin having charge transport ability allows formation of a protective layer having high mechanical strength, excellent transparency, and high charge transport ability when it is polymerized with unsaturated carboxylic acid having a group shown by Chemical formula (1), and by mixing a multi-functional unsaturated carboxylic acid, preferably oct- or more functional unsaturated carboxylic acid into the mono-functional unsaturated carboxylic acid having the group shown by Chemical formula (1), the acryl resin forms cross-linked structure, and becomes thermosetting polymer so that the mechanical strength of the protective layer is very high. The group of Chemical formula (1) may be added to multi-functional unsaturated carboxylic acid, however, such method increases the production cost of monomer. Therefore, it is generally preferred to use a photo-curing functional monomer rather than adding the group of Chemical formula (1) to the multi-functional unsaturated carboxylic acid.

As the mono-functional unsaturated carboxylic acid having the group of Chemical formula (1), Chemical formulas (2) and (3) can be exemplified as follows:

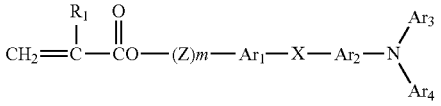

(2)

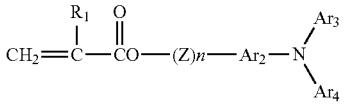

(3)

In these formulas, $R_1$ represents hydrogen atom, halogen atom, optionally substituted alkyl group, optionally substituted aralkyl group, optionally substituted aryl group, cyano group, nitro group, alkoxy group, —$COOR_7$ ($R_7$ represents hydrogen atom, optionally substituted alkyl group, optionally substituted aralkyl group or optionally substituted aryl group), halogenated carbonyl group or $CONR_8R_9$ ($R_8$ and $R_9$ each represent hydrogen atom, halogen atom, optionally substituted alkyl group, optionally substituted aralkyl group or optionally substituted aryl group, which may be identical or different from each other), and $Ar_1$ and $Ar_2$ each represent a substituted or unsubstituted arylene group, which may be identical or different. $Ar_3$ and $Ar_4$ each represent an optionally substituted aryl group, which may be identical or different. X represents a single bond, optionally substituted alkylene group, optionally substituted cycloalkylene group, optionally substituted alkylene ether group, oxygen atom, sulfur atom, or vinylene group. Z represents optionally substituted alkylene group, optionally substituted alkylene ether bivalent group, or alkylene oxycarbonyl bivalent group. M and n each represent an integer from 0 to 3.

Proportion of multi-functional unsaturated carboxylic acid is 5 to 75% by weight, preferably 10 to 70% by weight, and more preferably from 20 to 60% by weight of the entire protective layer. Proportion of multi-functional unsaturated carboxylic acid of equal to or less than 5% by weight is not preferable because mechanical strength of the protective layer is insufficient, and proportion of multi-functional unsaturated carboxylic acid of equal to or more than 75% by weight is not preferable because cracking is likely to occur when strong force is applied on the protective layer, and sensitivity is likely to degrade.

When acryl resin is used in the protective layer, the above unsaturated carboxylic acid is applied to the photoconductor, and radical polymerization is induced by electron beam radiation, or radiation of active beam such as UV ray to form a protective layer. When radical polymerization by active beam is conducted, unsaturated carboxylic acid dissolving a photo polymerization initiator is used. As the photo polymerization initiator, materials which are usually used for photo-curing coating materials may be used.

In the protective layer, microparticles of metal or metal oxide may be dispersed in order to improve the mechanical strength of the protective layer. As the metal oxide, titanium oxide, tin oxide, potassium titanate, TiO, TiN, zinc oxide, indium oxide, antimony oxide and the like can be exemplified. Besides, fluorine resins such as polytetrafluoroethylene, silicone resins, and inorganic materials in which such resins are dispersed may be added in order to improve the abrasion resistance.

On both ends of a photoconductor formed by providing a photosensitive layer on a drum-like conductive support, usually provided is a flange that supports the photoconductor and transmits rotation from a driving unit of main body. For the flange, engineering plastic having excellent mechanical strength such as polyamide, polyacetal, polyethylene terephthalate, polyphenylene sulfide, polyether ketone, liquid crystal polymer, polycarbonate, polyphenylene ether, polyarylate, polysulfone, polyether sulfone, polyether imide, polyamidoimide is used, and for controlling mechanical strength, rigidity, conductivity and the like, fibers such as glass fiber or carbon fiber, fillers such as carbon, talc, kaolin, calcium carbonate, alumina or silica, or other various additives are used in mixing manner. Such flange is pressed into the drum-like conductive support, and fixed by an adhesion or the like.

In the image forming apparatus of the present invention, formation of high quality image is enabled in both monochromic image formation and color image formation, and it is particularly advantageous in color image formation for which high quality image formation is demanded, and life times of the photoconductor and the charge roller can be greatly elongated while formation of high quality image is enabled. When the image forming apparatus of the present invention is able to form color image, it exerts excellent performance both in a system in which a single photoconductor is used, and after developing different colors of toner on the photoconductor, a toner image of each color on the photoconductor is sequentially transferred to an intermediate transfer member or image carrier, to thereby form an image; and in a tandem-type image forming apparatus in which photoconductors of the number of toner colors are used, and each color of toner is developed on an individual photoconductor, and transferred to an intermediate transfer member or an image carrier, to thereby form an image. In a tandem-type image forming apparatus, it is necessary to employ a charging step by charge roller for preventing oxidative gas such as ozone from generating in association with the charging, and the charging used in the image forming apparatus of the present invention in particular, generates little oxidative gas because the charging condition is gentle. Therefore, the image forming apparatus of the present invention is not only able to form an image of high quality and high reliability, but also is an environmentally-friendly excellent image forming apparatus.

Figure 2:
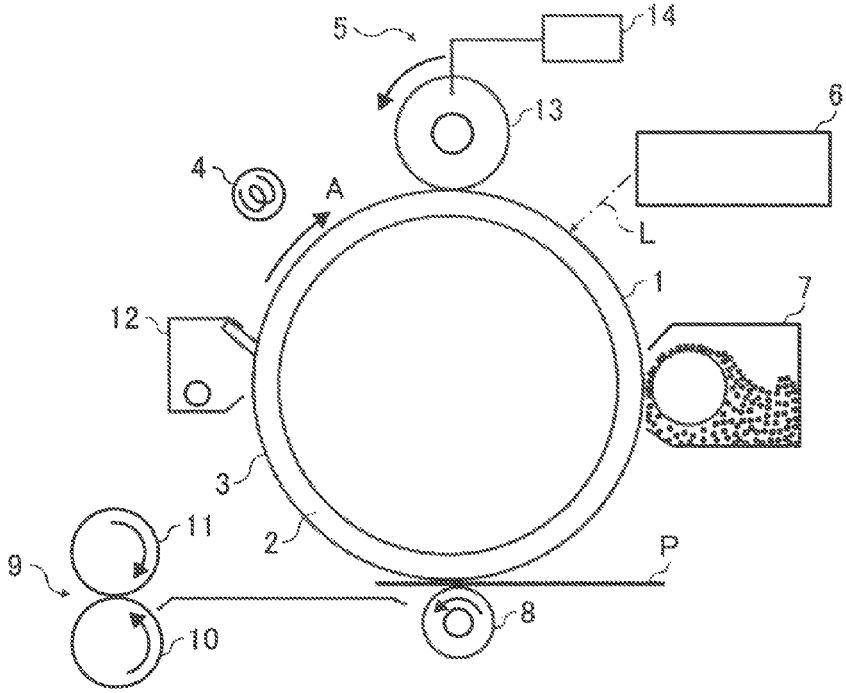
FIG. 2 is a conceptual view of an image forming apparatus that is evaluated by an evaluation method of the present invention.

FIG. 2 is a schematic view of an image forming apparatus evaluated by an evaluation method of the present invention.

In FIG. 2, the reference numeral 1 denotes a photoconductor, the reference numeral 2 denotes a conductive support, the reference numeral 3 denotes a photosensitive layer, the reference numeral 4 denotes a neutralization lamp, the reference numeral 5 denotes a charging device, the reference numeral 6 denotes a laser writing unit serving as an exposure device, the reference numeral 7 denotes a developing device, the reference numeral 8 denotes a transfer device, the reference numeral 9 denotes a fixing device, the reference numeral 10 denotes a fixing roller, the reference numeral 11 denotes a pressurizing roller, the reference numeral 12 denotes a cleaning device, the reference numeral 13 denotes a charge roller, and the reference numeral 14 denotes a power supply.

Evaluation method of a charging step of the present invention will be explained more specifically with reference to drawings.

The image forming apparatus illustrated herein is embodied by a copying machine, a printer, a facsimile machine or a multifunction product having at least two of these facilities. In a casing of main body not illustrated in the drawing, a photoconductor 1 which is one example of a member to be charged is disposed, and the photoconductor 1 is formed of a photoconductor in which a photosensitive layer 3 is laminated on the outer circumference of the drum-like conductive support 2. A photoconductor formed of a belt-like photoconductor which is driven to travel while it is wounded on a plurality of rollers, or a drum-like or belt-like photoconductor formed of a dielectric material may be used.

In an image forming operation, the photoconductor 1 is driven to rotate in the clockwise direction in FIG. 2, and the surface thereof moves in the direction of the arrow A. At this time, the surface of the photoconductor is initialized by irradiation of light from the neutralization lamp 4, and then the surface of the photoconductor is charged into a predetermined polarity by the charging device 5. As to the charging device 5, detailed description will be given later.

The surface of the photoconductor charged by the charging device 5 is irradiated with light-modulated laser beam L emitted from the laser writing unit 6 which is one example of an exposing device, whereby a latent image is formed on the surface of the photoconductor. Then the latent image is visualized as a toner image by toner that is charged into a predetermined polarity, when it passes through the developing device 7.

On the other hand, between the transfer device 8 disposed to face with the photoconductor 1 and the photoconductor 1, a transfer material P embodied, for example, by a transfer sheet is fed in predetermined timing, and at this time, the toner image formed onto the photoconductor is electrostatically transferred on the transfer material P. The transfer material P on which the toner image is transferred passes between the fixing roller 10 and the pressurizing roller 11 of the fixing device 9, and at this time, the toner image is fixed onto the transfer material by an action of heat and pressure. Transfer residual toner which is not transferred to the transfer material and left on the surface of the photoconductor will be removed by the cleaning device 12.

The charging device 5 has, the charge roller 13 disposed to face with a moving face to be charged, or the surface of photoconductor 1 in the illustrated example, and the power supply 14 for applying voltage on the charge roller 13. This power supply 14 applies voltage on the charge roller 13 to cause discharge between the charge roller 13 and the photosensitive layer 3, thereby charging the surface of the photoconductor into a predetermined polarity.

Structure of layers of charge roller 13 includes preferably a polymer layer and a superficial layer on a conductive support.

The conductive support 2 also functions as an electrode of charge roller and a supporting member, and is made, for example, of metal such as aluminum, copper alloy or stainless steel, or conductive material such as resin of iron-conductive agent plated with chromium or nickel.

As the polymer layer, a conductive layer having resistance of $10^6$ to $10^9$ Ω·cm is preferred, and those with modified resistance through mixing of a conductive material in a polymer material are used. As the polymer in the polymer layer in the charge roller used in the image forming apparatus of the present invention, polyester or olefin thermoplastic elastomers, styrene thermoplastic resins such as polystyrene, styrene-butadiene copolymer, styrene-acrylonitrile copolymer and styrene-butadiene plus acrylonitrile copolymer, rubber materials such as isoprene rubber, chloroprene rubber, epichlorohydrin rubber, butyl rubber, urethane rubber, silicone rubber, fluorine rubber, styrene-butadiene rubber, butadiene rubber, nitrile rubber, ethylene propylene rubber, epichlorohydrin-ethylene oxide copolymer rubber, epichlorohydrin-ethylene oxide-allylglycidyl ether copolymer rubber, ethylene-propylene-diene ternary copolymer rubber (EPDM), acrylonitrile-butadiene copolymer rubber, natural rubber, and mixture thereof are exemplified. Among these rubber materials, silicone rubber, ethylene propylene rubber, epichlorohydrin-ethylene oxide copolymer rubber, epichlorohydrin-ethylene oxide-allyglycidyl ether copolymer rubber, acrylonitrile-butadiene copolymer rubber and blended rubbers thereof are preferably used. These rubber materials may be foamed or unfoamed.

As the conductive material, an electron conductive agent or an ion conductive agent is used. Examples of the electron conductive agent include micro powder such as carbon blacks such as ketjen black or acetylene black; pyrolytic carbon, graphite; various conductive metal or alloy such as aluminum, copper, nickel, stainless steel; various conductive metal oxide such as tin oxide, indium oxide, titanium oxide, tin oxide-antimony oxide solid solution, tin oxide-indium oxide solid solution; insulation substances whose surface is processed to have conductivity. Examples of the ion conductive agent include perchlorates or chlorates such as tetraethyl ammonium or lauryltrimethyl ammonium; and perchlorates or chlorates of alkaline metals or alkaline earth metals such as lithium or magnesium. These conductive agents may be used singly or in combination of two or more kinds. The adding amount is not particularly limited, however, in the case of the electron conductive agent, the adding amount is preferably within the range of 1 to 30 parts by weight, and more preferably within the range of 15 to 25 parts by weight, relative to 100 parts by weight of polymer. In the case of the ion conductive agent, the adding amount is preferably within the range of 0.1 to 5.0 parts by weight, and more preferably within the range of 0.5 to 3.0 parts by weight, relative to 100 parts by weight of polymer.

As the polymer material constituting the superficial layer, there is no particular limitation insofar dynamic ultra-micro hardness of the surface of the charge roller 21 falls within the range between 0.04 and 0.5 inclusive, and polyamide, polyurethane, polyvinylidene fluoride, ethylene tetrafluoride copolymer, polyester, polyimide, silicone resin, acryl resin, polyvinyl butylal, ethylene tetrafluoroethylene copolymer, melamine resin, fluorine rubber, epoxy resin, polycarbonate, polyvinylalcohol, cellulose, polyvinylidene chloride, polyvinyl chloride, polyethylene, and ethylene vinyl acetate copolymer can be exemplified.

Among these, from the viewpoint of releasability from toner, polyamide, polyvinylidene fluoride, ethylene tetrafluoride copolymer, polyester, polyimide are preferably used. These polymer materials may be used singly or in mixture of two or more kinds. Number average molecular weight of the polymer material is preferably in the range of 1,000 to 100,000, and more preferably in the range of 10,000 to 50,000.

The superficial layer is formed as a composition by mixing the conductive agent used for the conductive elastic layer or various microparticles into the above polymer material. As the microparticles, metal oxides and composite metal oxides such as silicon oxide, aluminum oxide and barium titanate, polymeric pulverized materials of tetrafluoroethylene, vinylidene fluoride or the like may be used singly or in mixture, without limited thereto.

In the image forming apparatus of the present invention, designing the photoconductor, the charge roller, the developing device, and the cleaning device integrally in the form of a so-called process cartridge which is handled as a replaceable part is very desirable from the viewpoint of improvement in maintainability.

EXAMPLE 1

On an aluminum drum (conductive support) of 30 millimeters in diameter, a backing layer, a charge generation layer, a charge transport layer and a protective layer were applied in this order, and then dried, to manufacture a photoconductor made up of a backing layer of 3.6 micrometers, a charge generation layer of 0.15 micrometer, a charge transport layer of 23 micrometers, and a protective layer of about 3.5 micrometers. At this time, the protective layer was applied by spraying, while the other layers were applied by dipping application. The protective layer was added with 24.0% by weight of alumina having average particle diameter of 0.17 micrometers.

As a charge roller of photoconductor unit for black in Imagio Neo C385 modified machine (tandem color image forming apparatus; DC voltage of 2200V was applied to charge roller; linear velocity of photoconductor: modified to 120 m/s, resolution of writing light: 1200 dots per inch, available from RICOH), four charge roller specimens (A, B, C, D) purchased from a manufacturer of charge roller were evaluated. These charge rollers are manufactured by bonding conductive rubber based on epichlorohydrin rubber and conductive carbon, on a stainless cylinder.

Any of the charge rollers had a diameter of charge roller of 14.4 millimeters. This charge roller was disposed directly above the photoconductor, and the charge roller was forced against the photoconductor by spring, and in the condition that the photoconductor and the charge roller are not rotated, 0.5 millisecond application of DC voltage of −2100V between the photoconductor and the charge roller from both sides of nip part of photoconductor and charge roller and 0.5 millisecond suspension of application were repeated under illumination of fluorescent lamp, and charging was allowed for 20 minutes. The photoconductor was observed to reveal that two white lines occur in the photoconductor and interval w between these lines were 1.0 millimeters, 1.8 millimeters, 2.8 millimeters, and 4.7 millimeters, respectively in the specimens A to D of charge roller. Therefore, L/v was 0.008 second, 0.015 second, 0.023 second, and 0.039 second, respectively.

These charge rollers were incorporated into respective stations of black, cyan, yellow and magenta of imagio Neo C385 modified machine, and after copying a color test chart 5000 times at image density of 5%, the charge rollers were replaced by a new charge roller of photoconductor unit for black. A monochromic half-tone image was outputted, and fine horizontal lines were sparsely observed in the charge roller specimen D. High quality image could be formed in the cases using other charge rollers.

EXAMPLE 2

In Example 1, linear velocity of the image forming apparatus was modified to 285 m/s, and DC voltage of −2300V was applied between the photoconductor and the charge roller, and the charge roller specimen C was set in black and cyan station, and the charge roller specimen A was set in yellow station, and the charge roller specimen B was set in magenta station. L/v of these charge rollers were 0.004 second, 0.007 second, and 0.010 second, respectively.

After a color test chart was copied 5000 times at image density of 5%, the charge rollers were replaced by a new charge roller of photoconductor unit for black. A monochromic half-tone image was outputted, and dot-like abnormal image was observed only in the charge roller specimen A.

EXAMPLE 3

In Example 2, the charge roller specimen B was mounted in every color of station, and 30000 images were formed by a color test chart at image density of 5%. Then, a close-up image of face of woman taken by a digital still camera was outputted, and an image of high quality was obtained.

COMPARATIVE EXAMPLE 1

An image forming apparatus which was manufactured in a similar manner as Example 3 except that DC voltage of −900 volts and AC voltage having frequency of 1850 hertz and amplitude of 1350V were applied to the charge roller, and 30000 images were formed by a color test chart. Then a close-up image of face of woman taken by a digital still camera was outputted, and a band-like abnormal image was observed in the resultant image. The charge roller and the photoconductor were observed and film-like adhesion of foreign substance was found on charge rollers and photoconductors of every station.

EXAMPLE 4

After forming 500 images by a color test chart at image density of 5% by each photoconductor station used in Example 3 while resolution of writing light in Example 3 was modified to 2000 dots per inch, a close-up image of face of woman taken by a digital still camera was outputted similarly to Example 3, and high quality image was obtained.

EXAMPLE 5

An image forming apparatus which was identical to Example 3 except that outer diameter of charge roller was 21 millimeters in formulation of specimen A was prepared. L/v of this charge roller was 0.006 second. After forming 500 images by a color test chart at image density of 5%, a close-up image of face of woman taken by a digital still camera was outputted, and high quality image was obtained.

According to the embodiments of the present invention, it is possible to provide an image forming apparatus capable of obtaining uniform charging potential even in high speed image formation, causing less oxidative deterioration of photoconductor and charge roller, and realizing long life times of photoconductor and charge roller.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a photoconductor configured to be driven to rotate at linear velocity v (millimeters/second) at the time of image formation;

a charge roller that is in contact with the photoconductor and that is configured to rotate along with the photoconductor, the charge roller having an outer diameter; and a charging unit configured to apply direct current voltage between the charge roller and the photoconductor, wherein the outer diameter of the charge roller and the linear velocity v of the photoconductor are predetermined such that a ratio w/v is from 0.005 to 0.035 (seconds), wherein w (millimeters) is a distance between two discharge marks occurring on the photoconductor upon intermittent application of the direct current voltage for a predetermined time while the photoconductor and the charge roller are not rotating in an environment where the photoconductor and the charge roller are illuminated with light.

2. The image forming apparatus according to claim 1, wherein the direct current voltage includes repetitions of 0.5 millisecond application and 0.5 millisecond suspension over 20 minutes.

3. The image forming apparatus according to claim 1, wherein the outer diameter of the charge roller is from 12 millimeters to 25 millimeters.

4. The image forming apparatus according to claim 1, wherein the charge roller has elasticity near at least a surface thereof, and a part where the charge roller contacts the photoconductor is deformable.

5. The image forming apparatus according to claim 1, wherein the image forming apparatus is a tandem image forming apparatus.

6. The image forming apparatus according to claim 1, wherein the image forming apparatus is able to form an image at a maximum resolution of equal to or more than 1000 dots per inch.

7. The image forming apparatus according to claim 1, wherein the direct current voltage is from −1500 to −3000 V.

8. The image forming apparatus according to claim 1, where an intensity of light illuminating the photoconductor and the charge roller is from 120to 500 lx.

9. The image forming apparatus according to claim 1, wherein the value of w is from 1.2 to 3.5 mm.

10. The image forming apparatus according to claim 1, wherein the value of v is from 100 to 400 mm/s.

11. The image forming apparatus according to claim 1, wherein the charge roller includes a metal cylinder and conductive rubber provided around the metal cylinder.

12. A process cartridge for use in an image forming apparatus, the process cartridge integrally comprising:

a photoconductor configured to be driven to rotate at linear velocity v (millimeters/second) at the time of image formation;

a charge roller that is in contact with the photoconductor and that is configured to rotate along with the photoconductor, the charge roller having an outer diameter;

a charging unit configured to apply direct current voltage between the charge roller and the photoconductor;

a developing device that develops an image formed on the photoconductor with toner; and a cleaning device that cleans residual toner on the photoconductor, wherein the outer diameter of the charge roller and the linear velocity v of the photoconductor are predetermined such that a ratio w/v is from 0.005 to 0.035 (seconds), wherein w (millimeters) is a distance between two discharge marks occurring on the photoconductor upon intermittent application of the direct current voltage for a predetermined time while the photoconductor and the charge roller are not rotating in an environment where the photoconductor and the charge roller are illuminated with light.

13. The process cartridge according to claim 12, wherein the direct current voltage includes repetitions of 0.5 millisecond application and 0.5 millisecond suspension over 20 minutes.

14. The process cartridge according to claim 12, wherein the outer diameter of the charge roller is from 12 millimeters to 25 millimeters.

15. The process cartridge according to claim 12, wherein the direct current voltage is from −1500 to −3000 V.

16. The process cartridge according to claim 12, where an intensity of light illuminating the photoconductor and the charge roller is from 120 to 500 lx.

17. The process cartridge according to claim 12, wherein the value of w is from 1.2 to 3.5 mm.

18. The process cartridge according to claim 12, wherein the value of v is from 100 to 400 mm/s.

19. The process cartridge according to claim 12, wherein the charge roller includes a metal cylinder and conductive rubber provided around the metal cylinder.

20. A method for an image forming apparatus, of setting an outer diameter of a charge roller and a linear velocity v of a photoconductor, wherein the image forming apparatus includes the photoconductor, a driving unit configured to rotate the photoconductor at the linear velocity v (millimeters/second) at the time of image formation, the charge roller that is in contact with the photoconductor and that is configured to rotate along with the photoconductor, and a charging unit configured to apply direct current voltage between the charge roller and the photoconductor, the method comprising:

forming discharge marks on the photoconductor by applying intermittent application of the direct current voltage for a predetermined time while the photoconductor and the charge roller are not rotating in an environment where the photoconductor and the charge roller are illuminated with the light;

measuring a value w (millimeters), which is a distance between two discharge marks occurring on the photoconductor; and setting at least one of the linear velocity v and the outer diameter of the charge roller such that a ratio w/v is from 0.005 to 0.035 (seconds).

21. The method according to claim 20, wherein the setting step includes:

at a given linear velocity v, determining whether or not a ratio w/v is from 0.005 to 0.035 (seconds); and when the ratio w/v is not from 0.005 to 0.035 seconds, performing one or both of (i) increasing or decreasing the given value of the linear velocity v, and repeating the measuring step until the ratio w/v is from 0.005 to 0.035 seconds and (ii) repeating the forming step and measuring step using a new charge roller having an increased or decreased diameter until the ratio w/v is from 0.005 to 0.035 seconds.

* * * * *